United States Patent [19]

Di Rosa

[11] 4,060,122

[45] Nov. 29, 1977

[54] LOW-PRESSURE DIE CASTING MACHINE

[75] Inventor: Gaetano Di Rosa, Pino Torinese (Turin), Italy

[73] Assignee: FATA S.p.A., Turin, Italy

[21] Appl. No.: 764,144

[22] Filed: Jan. 31, 1977

[30] Foreign Application Priority Data

Feb. 4, 1976 Italy ..... 67255/76

[51] Int. Cl.[2] ..... B22D 17/00

[52] U.S. Cl. ..... 164/304; 164/305; 164/306; 164/347

[58] Field of Search ..... 164/113, 119, 303, 306, 164/307, 308, 309, 310, 311, 337, 347, 304, 305

[56] References Cited

U.S. PATENT DOCUMENTS 3,874,440 4/1975 Vosin ..... 164/306

FOREIGN PATENT DOCUMENTS 463,513 4/1975 U.S.S.R. ..... 164/306

*Primary Examiner*—Robert D. Baldwin

*Attorney, Agent, or Firm*—Sughrue, Rothwell, Mion, Zinn and Macpeak

[57] ABSTRACT

A low pressure die casting machine for light alloys, of the type in which a charge of molten alloy is received in a charging chamber which is then closed and pressurized to drive the molten alloy into a die chamber formed by a plurality of separable die elements, in which the problems due to head metal and casting sprue in the casting passages and gates is minimized by forming these latter, as well as the charging chamber, as recesses in cooperating faces of two of the die elements, these recesses being so shaped that upon separation of the two die elements the casting sprue and head metal are exposed and can be ejected still attached to the casting without fouling any part of the die casting machine and without leaving any solidified head metal behind which might cause blockage problems unless it were maintained in a molten state.

5 Claims, 5 Drawing Figures

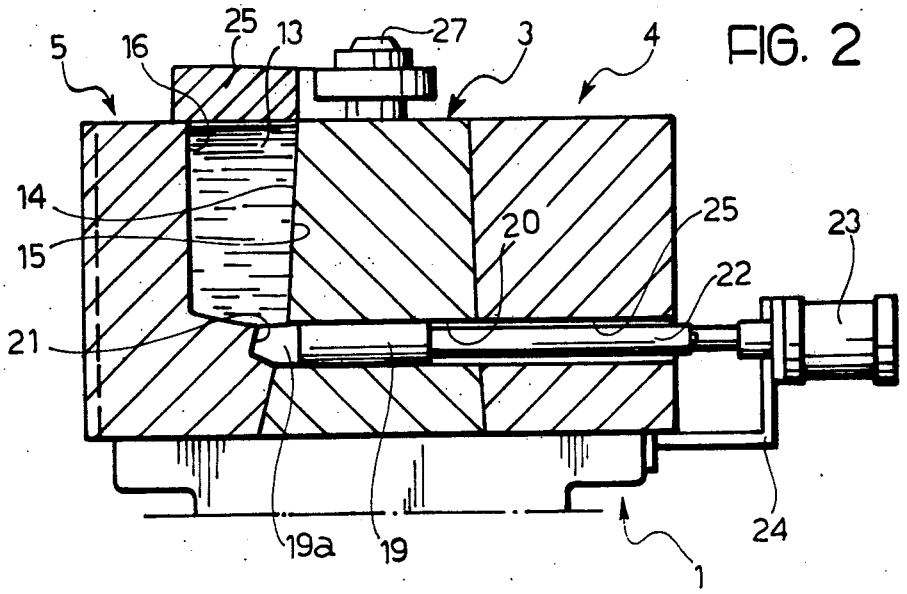
FIG. 2
FIG. 4
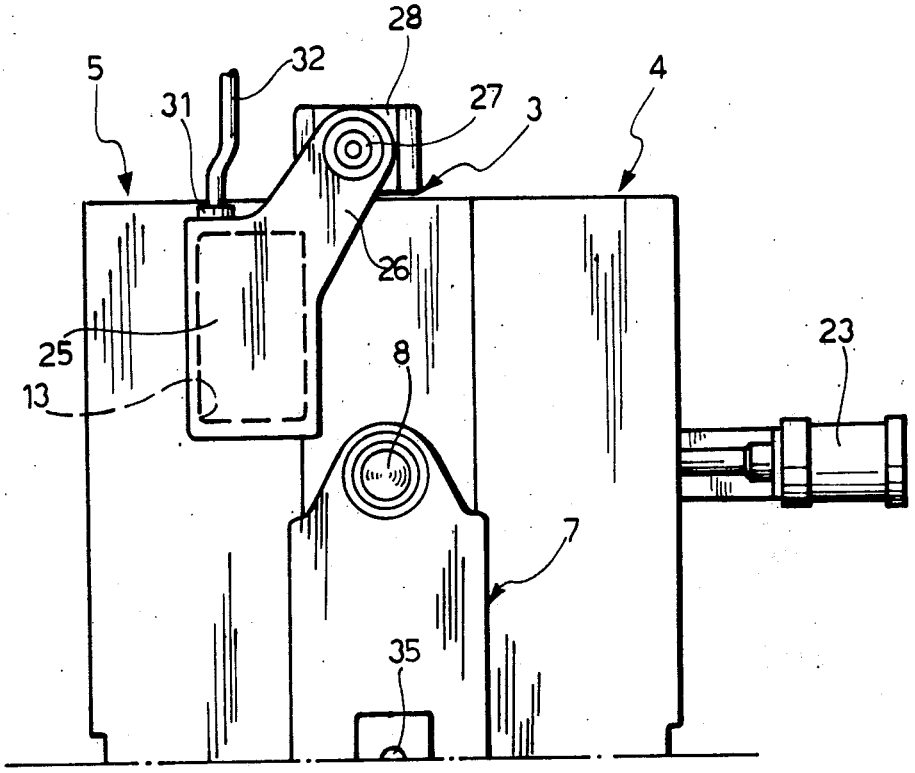

7
35
9
9

23
4
25
26
27
31
8
22
32
P
8
28
14
16
M
29
3
A
A
C
1
2
5

LOW-PRESSURE DIE CASTING MACHINE

The present invention relates to a low pressure die-casting machine and particularly to a machine for making light alloy castings, of the type comprising a die which consists of several separable cooperating die elements which define between them a die cavity, at least two die elements being separable by a relative horizontal movement, a charging chamber which is closable in a pressure-tight manner and which, in use of the machine, receives a charge of molten alloy to be cast in the die cavity, the said charging chamber being connected to the die cavity by means of a casting conduit which communicates with the lower part of said charging chamber and is connected to the lower part of the said die cavity by means of a plurality of gates, and means for applying to the interior of the charging chamber, above the space occupied by a charge of molten alloy, a pressure above atmospheric whereby to urge the molten allow along the casting conduit and into the casting cavity.

British Pat. No. 762,482, and French Pat. No. 2,210,467 disclose and describe die casting machines of this general type, in which the charging chamber associated with the die cavity is a tank which, in use of the machine contains a charge of alloy in its molten state, before casting; this tank is located below the said casting cavity defined by the die elements and communicates with the casting cavity defined by the die elements by means of one or more vertical tubes or pipes which extend from the bottom of the tank to the bottom of the said casting cavity. This arrangement aims to reduce as far as possible the amount of metal left in the machine and which is in excess of that actually required to enter the casting cavity to form the casting. Since between one casting and the next a certain quantity of alloy always remains at the bottom of the tank, it is necessary to provide, in such a construction, means for heating the tank so as to prevent the alloy in it from solidifying. Apart from the added complexity due to the presence and control of such heating means, known machines also suffer from a further disadvantage in that the quantity of alloy remaining at the bottom of the tank after a die casting operation is inevitably subject to oxidation, with consequent possibility that subsequent castings will have defects due to this oxidation. Another disadvantage is due to the fact that, because of the presence of the lower tank and of its heating means, the height of the die casting machine is excessive.

This invention seeks therefore to provide a casting machine of the general type referred to above, but in which the disadvantages of the known die casting machines discussed above have been eliminated or at least substantially reduced, and in which it is nevertheless possible to make light alloy castings with considerable saving in alloy by using a very small head volume.

According to the present invention there is provided a low pressure die casting machine for light alloy castings, of the type comprising a die which consists of several separable cooperating die elements which define between them a die cavity, at least two die elements being separable by a relative horizontal movement, a charging chamber which is closable in a pressure-tight manner and which, in use of the machine, receives a charge of molten alloy to be cast in the die cavity, the said charging chamber being connected to the die cavity by means of a casting conduit which communicates with the lower part of the said charging chamber and is connected to the lower part of the said die cavity by means of a plurality of gates and means for applying to the interior of the charging chamber, above the space occupied by a charge of molten alloy, a pressure above atmospheric whereby to urge the molten alloy along the casting conduit and into the casting cavity, characterised in that the said chamber is formed in the die to one side of the said die cavity and is provided with a removable cover which can close the chamber in a pressure-tight manner, in that the bottom of the chamber, the casting conduit and the casting gates are all located at a level corresponding substantially to that of the lower portion of the die cavity, in that the charging chamber, the casting conduit and the casting gates are constituted by recesses in the facing surfaces of the said two die elements which are separable by a relative horizontal movement, the said recesses being so shaped that any alloy which solidifies in the said casting conduit or the casting gates defined thereby does not impede the opening movement of the said two die elements or the subsequent ejection of the casting, and in that within the die there are provided valve means for selectively closing communication between the said chamber and the casting.

Because of this arrangement, in embodiments of the invention, it is only necessary each time a casting is to be made, to introduce into the charging chamber a charge of molten alloy having a volume very little greater than the combined volume of the casting cavity itself together with the casting conduit and the gates. The size of this charge will preferably be such that after solidification of the alloy there shall remain at the bottom of the charging chamber, as head metal, only a very thin layer of solidified alloy.

Upon opening of the die, owing to the fact that the said charging chamber, the casting conduit and the gates are situated at a point where separation occurs between two die elements, the head metal and the casting sprue formed by the metal solidified in the casting conduit and the gates become uncovered and subsequently ejection of the casting can take place without difficulty. After ejection of the casting the machine is completely empty since the head metal and the casting sprue are ejected with the casting, so that the machine will be ready for the next casting operation without the need for any substantial cleaning operation of the recesses defining the casting conduit and the gates.

Finally, because there is no residue of alloy left in the said chamber at the end of a casting operation there is no need to have heating means for the said chamber.

One embodiment of the invention will now be more particularly described by way of example, with reference to the accompanying drawings, in which:

FIG. 2 is a diagrammatic cross-section taken on the line II—II of FIG. 1;

FIG. 4 is a diagrammatic view from above, of that part of the machine shown in FIG. 1 which lies to the left of the section line III—III.

Figure 3:
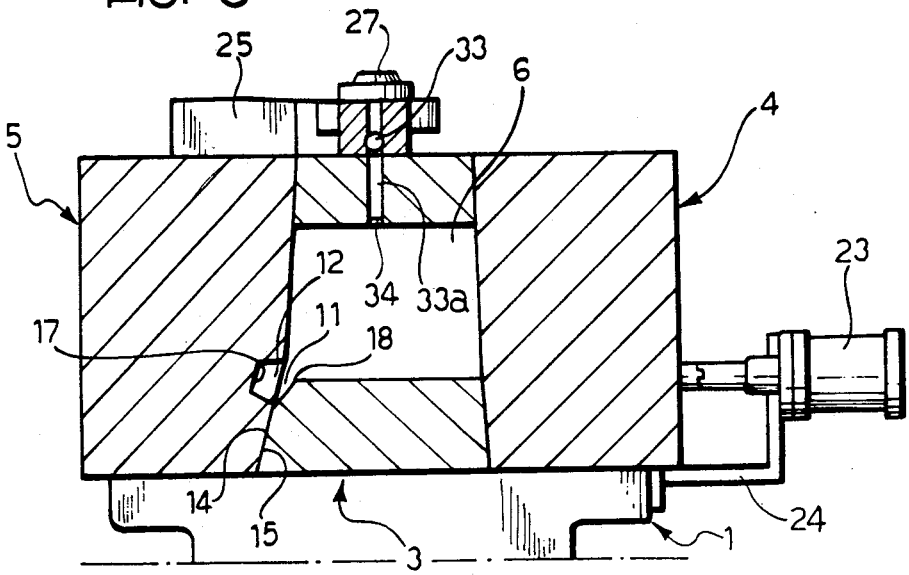
FIG. 3 is a diagrammatic cross-section taken on the line III—III of FIG. 1.

The die casting machine of the present invention, shown in the accompanying drawings, has a table 1 supported by the upper plate 2 of a base (not illustrated). Mounted on the table 1 is a central die element 3 which cooperates with a pair of lateral die elements 4 and 5 on respective sides thereof to form a die cavity 6 completed by an upper die element 7. The lateral die elements 4 and 5 can move substantially horizontally between an open position of the die (FIG. 5) and a closed position of the die (FIGS. 2, 3 and 4). Positioning of the upper die element is obtained, in a conventional manner, by means of pins 8 which project vertically from the central fixed die element 3, and which fit into corresponding holes 9 in the upper die element 7. Displacement of the upper die element 7 and the two lateral die elements 4 and 5 for closing and opening the die are effected, for example, by means of respective fluid pressure actuators (not shown in the drawing).

The shape of the die cavity 6 corresponds to the outer shape of the casting to be made thereby; in the example shown this is the cylinder head of an internal combustion engine. Within the die cavity there are located inner cores, such as that indicated 10 in FIG. 1.

Figure 1:
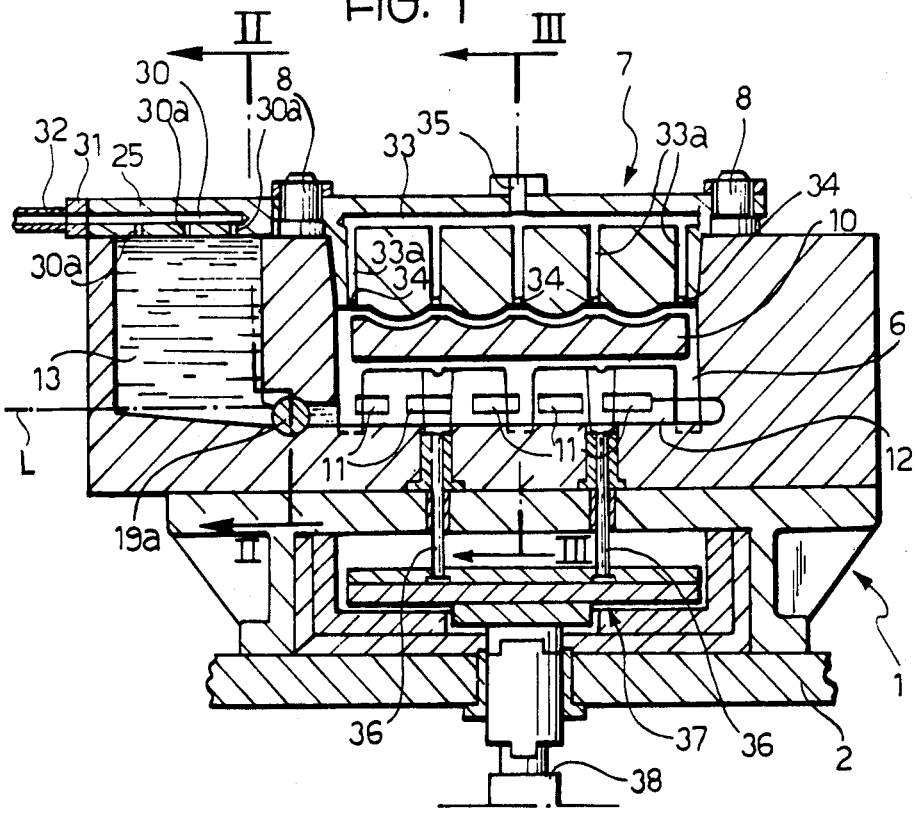
FIG. 1 is a diagrammatic longitudinal section of a die-casting machine formed as a preferred embodiment of the invention.

As can be seen from FIG. 1, the lower portion of the die cavity 6 communicates, via casting gates 11, with a casting conduit 12, which leads from the bottom of a charging chamber 13 which, in use, is charged with a filling of alloy in molten state to be cast in the die cavity 6. The chamber 13 is located in the die next to the die cavity 6. the bottom of the chamber 13, the casting conduit 12 and the casting gates 11 are all located at a level substantially corresponding to that of the lower portion of the die cavity 6.

Figure 5:
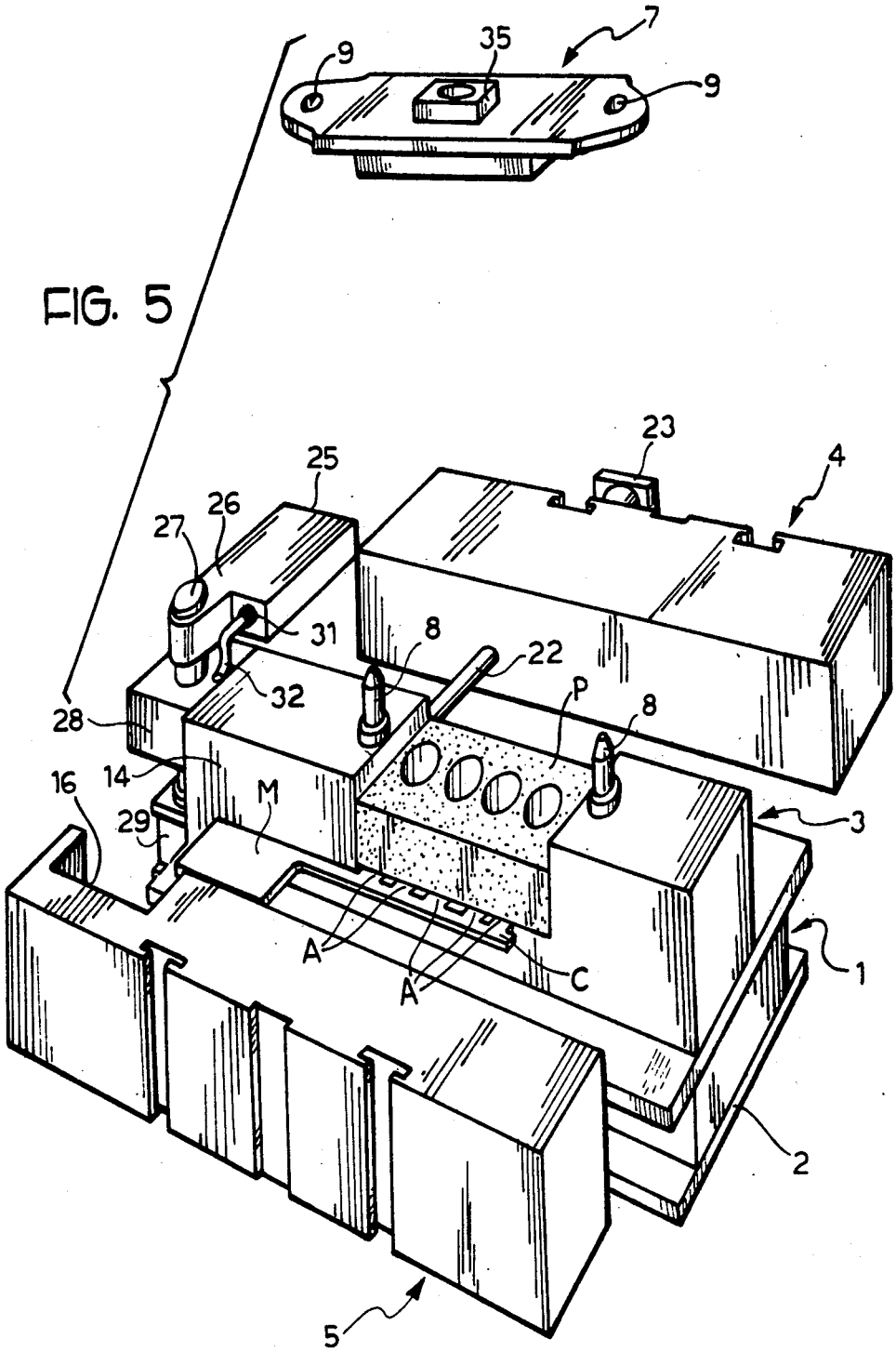
FIG. 5 is a diagrammatic perspective view showing the dies of the die casting machine in the open position with a completed casting in place ready for removal.

As can be better seen in FIGS. 2 and 5, one side of the charging chamber 13 is defined by a surface 14 of the fixed die element 3 which, in the closed state of the die is contacted by a corresponding surface 15 of the movable element 5, in which there is a recess 16 which defines the remaining sides of the chamber 13.

Similarly, as can best be seen in FIG. 3, the casting conduit 12 is defined on one side by a part of the facing surface 14 of the fixed die element 3, and on the other side by an elongate recess 17 in the facing surface 15 of the displaceable lateral die element 5. Finally, the casting gates 11 are defined by recesses formed, such as by chamfering, in the central fixed element 3, as illustrated by the reference 18 in FIG. 3.

It will be appreciated that the recesses which, when the die is closed, define the chamber 13, the casting conduit 12, and the casting gates 11, could all be made in the opposite facing surfaces of the fixed central die element 3 and the lateral displaceable die element 5, and/or in a different way from that illustrated, so long as these recesses are so formed that alloy solidified in them after a casting has been formed in the die cavity 6 will not impede the separation movement of the lateral displaceable element 5 from the fixed element 3 and the subsequent removal of the casting.

In the die, there are provided means for sealing the chamber 13 to prevent molten alloy therein from flowing along the casting conduit 12 and into the die cavity 6. As shown in FIGS. 1 and 2, this sealing means comprise a gate valve constituted by a shutter element in the form of the shaped head **19*a* of a piston 19 slidably housed in a horizontal bore hole 20 in the fixed die element 3, which extends in a direction parallel to that of the opening and closing movement of the displaceable lateral die element 5 in relation to the central fixed die element 3. The valve shutter element 19*a* is movable between a first positon in which it engages into a seating 21 of corresponding shape in the lateral, displaceable, die element 5, preventing communication between the chamber 13 and the casting conduit 12, and a second position in which it is withdrawn from the seating 21 along the hole 20 allowing communication between the chamber 13 and the casting conduit 12**.

The movement of the valve shutter element **19*a* in order to open and close the casting conduit 12, is achieved by means of a double acting fluid pressure actuator 23 connected by a rod 22 to the piston 19 which carries the valve shutter 19. The actuator 23 is supported by a table 1 by means of a bracket 24. The rod 22 passes freely through a hole 25 in the lateral displaceable die element 4, which hole extends in the same direction as the opening and closing movement of the element 4 in relation ot the fixed element 3, so that movements of the lateral displaceable die element 4 are not obstructed by the rod 22**.

Over the chamber 13 is a cover 25 consisting of a plate element which is fitted with an arm 26 (best seen in FIGS. 4 and 5) by means of which it is pivoted on a vertical shaft 27. This latter is slidably and pivotally mounted on a support block 28 secured to the fixed die element and extends above and below this block. Below the support block 28 the shaft 27 is connected to an actuator device 29, for example of the pneumatic or hydraulic type which, when operated, acts to give to the shaft 27 a vertical upward or downward movement and at the same time an angular movement in one direction or the other, so that the cover 25 can be displaced between a lowered position (FIG. 1), in which it closes and seals in a gas-tight manner the chamber, and a raised position in which it is turned through a certain angle, for example rotated by 90°, and in which the chamber 13 is uncovered as shown in FIG. 5.

In the cover 25 there is a duct 30 which, via passages **30*a* which open into its lower face, communicates with the upper portion of the chamber 13 when the cover 25** is closed over it.

The duct 30 is connected, via a pipe union 31, to a flexible pipe 32 which is connectable selectively by means not shown to a gas source (also not shown — usually air) at a pressure slightly above atmospheric pressure (normally between 0.1 and 0.6 at. above atmospheric pressure).

The casting machine of the invention also has various parts similar to those provided in conventional such machines. Thus, as can be seen in detail in FIG. 1, in the upper die element 7 there is a manifold breather duct 33 which communicates with the casting cavity 6 via parallel passages **33*a* at the mouth of each of which is provided a steel bush 34 having a number of small slits sufficient to allow the passage of gases and steam, but not the molten alloy when this fills the whole of the casting cavity 6. The breather duct 33 leads to a pipe union 35 which communicates directly with the atmosphere as shown in FIG. 1**, or else is connected to a breather pipe (not shown).

The casting machine also includes conventional ejector means consisting of rods 36 slidably mounted for back and forth movement in the fixed die element 3 and connected, by means of a yoke 37 in the table 1, to a pneumatic actuator (shown partially in the drawing and indicated by the reference numeral 38), which is carried by the base below the upper plate 2.

In operation of the die casting machine described above any necessary sand cores are first placed in the casting cavity 6 and this latter is then closed by displacing the lateral displaceable die elements 4 and 5 inwards until they contact the fixed central die element 3 and by fitting the upper die element 7 over the locating projections 8. The die elements 3 and 5, in the closed position, now together define the chamber 13, the casting conduit 12 and the casting gates 11. The casting conduit 12 is held closed by the valve shutter 19*a*, the piston 19 being in the first or advanced position. Then, with the cover 25 in the open position, there is poured into the charging chamber 13 a quantity of molten alloy corresponding to the volume of the die cavity 6 as well as that of the casting gates 11 and the casting conduit 12, plus a small quantity extra.

After the molten alloy has been poured into the charging chamber 13, the actuator 39 is operated to draw the cover 25 down to the closed position and then communication between the source of gas under pressure and the pipe union 31 is opened whereby to feed to the region above the molten alloy contained in the chamber 13 a gas pressure, which, as mentioned above, is preferably between 0.1 and 0.6 at. Air is normally used as the gas, since oxidation of the surface of the alloy, in the chamber 13 does not matter.

At this point the piston 19 is withdrawn to its second position opening the casting conduit 12 and the alloy in the chamber 13 then fills the casting conduit 12 and, feeding through the casting gates 11 progressively fills the whole die cavity 6 driven by the gas pressure in the chamber 13, which pressure is maintained until complete solidification of the alloy has taken place. In this way feeding of the casting alloy into the die cavity 6 is ensured and the same conditions obtain as in a normal gravity uphill teeming casting.

The quantity of alloy charged into the chamber 13 is such that, when solidification has taken place, the level if the solidified alloy in the chamber 13 will be that shown by the dot and dash line L in FIG. 1. The head metal will then consist of a thin plate form portion.

Once solidification has occurred the die is opened to the position illustrated in FIG. 5. The separation of the lateral displaceable die element 5 from the central fixed die element 3 now splits up the chamber 13 and the casting conduit 12, and at the same time this separating movement, together with that of the other displaceable die element exposes the solidified casting shown as P in FIG. 5. As can be seen in FIG. 5 there remain attached to the casting P, parts A of alloy which solidified in the casting gates, and parts C, of alloy which solidified in the casting conduit 12, as well as the thin head metal M which remained at the bottom of the chanber 13.

Finally, the casting P, with its casting sprue formed by the parts A, C and the head metal M, is ejected upwards by means of the ejectors 36. This ejection is not hindered by the gates or the head metal because when the element 5 has been displaced into the open position as shown in FIG. 5, there is no element above the sprue A, C or the head metal M which can interfere with this upward movement.

The excess quantity of alloy over and above that actually necessary for forming the casting, required by a die casting machine according to the present invention, is very small. From tests carried out, it has been confirmed that to make an internal combustion engine cylinder head weighing 18 Kg, only 20 Kg of light alloy are necessary, that is to say that the total weight of the head metal and the sprue is only 2 Kg. This means a considerable saving in the cost of recovery and remelting of that portion of original charge which is not actually used in forming a casting, over the cost of these operations when using conventional or known machines such as those discussed in the preamble to this specification.

What is claimed is:

1. In a low pressure die casting machine for light alloy castings, of the type comprising:

a plurality of cooperating die elements which define between them a die cavity, at least two of said die elements being separable by a relative horizontal movement, means defining a charging chamber which is closable in a pressure-tight manner and which, in use of the machine, receives a charge of molten alloy to be cast in said die cavity, casting conduit means connecting said charging chamber to said die cavity, said casting conduit means communicating at one end with the lower part of said charging chamber, a plurality of casting gates interconnecting said die cavity and the other end of said casting conduit means, and means for applying to the interior of said charging chamber, above the space occupied therein by a charge of molten alloy, a pressure above atmospheric pressure whereby to urge said charge of molten alloy along said casting conduit means and into said die cavity through said casting gates, the improvement which consists in:

said charging chamber is formed by means defining cooperating recesses in two of said die elements and is located to one side of said die cavity, means defining a removable cover which can close over said casting chamber in a pressure-tight manner, the bottom of said charging chamber, said casting conduit and said casting gates are all located at a level corresponding substantially to that of the lower portion of said die cavity, means defining recesses in facing surfaces of said two die elements defining said casting conduit and said casting gates, said recesses being so shaped that any alloy which solidifies in the said casting conduit, or said casting gates defined thereby does not impede the opening movement of said two die elements or the subsequent ejection of a casting made in the die constituted by said plurality of die elements, and valve means in said die for selectively closing communication between said charging chamber and said casting conduit.

2. A die casting machine as in claim 1, wherein said valve means in said die consists of a gate valve shutter slidably mounted in an elongate hole in one of said two die elements.

3. A die casting machine as in claim 2, wherein said gate valve shutter is horizontally slidable parallel to the direction of separation movement of the said two die elements.

4. A die casting machine as in claim 1, wherein said cover for closing said casting chamber is movable substantially vertically between a lowered, closed position and a raised position where it is displaced laterally from said lowered position and in which it leaves said chamber open to receive a charge of molten alloy.

5. A die casting machine as in claim 1, wherein said means for applying a pressure above atmospheric to said casting chamber includes means defining at least one passage formed in said cover, and which opens into its lower face.

* * * * *